US009554629B1

(12) United States Patent
Wilcox et al.

(10) Patent No.: US 9,554,629 B1
(45) Date of Patent: Jan. 31, 2017

(54) BRACELET ALERT DEVICE

(71) Applicants: Brenda M. Wilcox, Fort Lauderdale, FL (US); Joseph Mark Wilcox, Fort Lauderdale, FL (US)

(72) Inventors: Brenda M. Wilcox, Fort Lauderdale, FL (US); Joseph Mark Wilcox, Fort Lauderdale, FL (US)

( * ) Notice: Subject to any disclaimer, the term of this patent is extended or adjusted under 35 U.S.C. 154(b) by 0 days.

(21) Appl. No.: 15/069,115

(22) Filed: Mar. 14, 2016

(51) Int. Cl.
*A44C 5/00* (2006.01)
*G09F 3/02* (2006.01)

(52) U.S. Cl.
CPC ..... *A44C 5/0015* (2013.01); *G09F 3/02* (2013.01)

(58) Field of Classification Search
CPC ..... A44C 5/0015
See application file for complete search history.

(56) References Cited

U.S. PATENT DOCUMENTS 6,223,559 B1 * 5/2001 Coleman ..... A44C 15/0015 40/455
6,924,742 B2 8/2005 Mesina
6,930,614 B2 8/2005 Rackham et al.
6,998,988 B1 2/2006 Kalce
7,908,777 B1 * 3/2011 Beardsley ..... B60N 2/28 40/320
2006/0061201 A1 3/2006 Skinner
2006/0176183 A1 8/2006 Jetton
2006/0242875 A1 * 11/2006 Wilson ..... A44C 5/0015 40/633
2009/0113933 A1 * 5/2009 Hatem ..... G09B 21/009 63/1.13
2010/0083698 A1 * 4/2010 Secord ..... A44C 5/0015 63/1.13
2010/0144429 A1 * 6/2010 Ryan ..... G06F 21/6272 463/29
2013/0082831 A1 * 4/2013 Byrne ..... B60N 2/28 340/457
2014/0015664 A1 1/2014 Watson
2014/0223961 A1 * 8/2014 Mullins ..... A44C 5/0015 63/1.13

* cited by examiner

*Primary Examiner* — Gary Hoge
(74) *Attorney, Agent, or Firm* — Egbert Law Offices, PLLC

(57) ABSTRACT

Bracelet alert device used as a visual alert device that acts as a child safety/awareness imperative, worn as a bracelet. The device functions to prevent the tragedy of a baby being left in a hot car. The device has three signature, giant beads, a color matching functional carabiner for attachment with the male end of the auto seatbelt buckle, a color matching functional male end seatbelt adapter piece to fastened with the female end of the child safety seat belt buckle, and a matching "official child safety apparatus" tag, includes a card stock bookmark or a magnet, displaying a symbol and meaning of the various charms on one side and the instructions for properly using the said bracelet alert device the other side.

2 Claims, 3 Drawing Sheets

BRACELET ALERT DEVICE

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates generally to alert devices, and more particularly to a detachable alert device and method of use for remembering children left in child safety seat.

2. Description of Related Art Including Information Disclosed Under 37 CFR 1.97 and 37 CFR 1.98.

Increasingly, parents are becoming forgetful of their children, often unintentionally leaving them unattended in vehicles. Stressful daily lives with many tasks to perform cause a parent, or other person transporting children, to become distracted and inadvertently leave children upon departing a vehicle. Occasionally, the vehicle is shuttered and locked, even in hot weather, thereby potentially causing severe distress, injury, and/or death of a child left therein. In addition to injuries, children left alone in an otherwise unoccupied vehicle are potentially subject to kidnapping. With the need for multitasking, wherein many different needs are being addressed, and the consequent straining of the ability of a parent or caregivers to remember while busy and stressed, some form of reminding device would be advantageous.

A number of different types of reminder devices are available in prior art. For example, see: U.S. patent application Ser. No. 12/031,457, issued to Beardsley Victoria E provides a detachable alert device and method of its use. This device allows the user to remember a child left in a child safety seat, has an anchor element adapted to semi-permanently attach to the child safety seat. A reminder bracelet is adapted to removably attach to the anchor element and has a user engaging element adapted to removably attach the reminder bracelet to a user in a visible position; U.S. patent application Ser. No. 13/630,403, issued to Rachel Byrne, discloses a child safety alert device which includes a method for continuously alerting a user of a presence of a child in a car safety seat, the method including: providing an alert system including a continuous audible prompt, the alert system removably attached to the car safety seat; placing the child in the car safety seat; removing the alert system from the car safety seat; transferring the alert system to a location visible to the user, such that the user remains continuously alert to the presence of the child in the car safety seat, until the child is removed from the car safety seat; U.S. patent application Ser. No. 10/828,867, issued to Kalce Paul D teaches an electronic infant alarm system for automobiles for sounding an alarm when the driver seat is unoccupied. The system includes a pressure sensor pad for detecting the presence of a person in a car seat, and a belt buckle switch for determining whether a belt buckle is buckled into an infant car seat; U.S. patent application Ser. No. 10/160,648, issued to International Business Machines Corporation teaches a similar alarm system, integrated into a motor vehicle that triggers an alarm if the driver's door is open and the engine is turned off but there still is an occupant in the motor vehicle.

Therefore, it is readily apparent that there is a need for a seat belt restraint and alarm system and method of use thereof, wherein a parent or other caregiver who is leaving the vicinity of a vehicle is reminded of the fact that the seat belt securing the child, or the child's seat, is still engaged and that potentially hazardous condition exists for the child.

Accordingly, the present invention fulfills these needs and provides further related advantages as described in the following summary.

BRIEF SUMMARY OF THE INVENTION

In view of the foregoing disadvantages inherent in the known types of alarming devices now present in the prior art, the present invention provides an alert device and the method of use wherein the same provides a bracelet to remind the parents for child safety and awareness and use on process of various components employed in the procedure. As such, the general purpose of the present invention, which will be described subsequently in greater detail, is to provide a new and improved alert device which has all the advantages of the prior art and none of the disadvantages.

Accordingly, it is a primary aspect of the present invention which is designed intrinsically to provide an alert device that acts as a child safety/awareness imperative, worn as a bracelet; and functions to prevent the tragedy of a baby being left in a hot car.

In another aspect, the present invention provides an easy and automatic bracelet alert device fastened in/on the male or female end of the child safety seat belt buckle.

It is yet another aspect of the present invention where the bracelet comprises the three signatures, giant beads with the "Bring Baby Bracelet" (BBB) logo, a color matching functional carabiner for attachment with the male end of the child safety seat belt buckle, and a color matching functional male end seatbelt adapter piece to fasten with the female end of the child safety seat belt buckle.

In a further aspect, the bracelet comprises a card stock bookmark or a magnet that on one side displays a symbol and meaning of the various charms and the other side displays the instructions for properly using the inventive device.

Additionally, the bracelet is equipped with multiple adapter pieces to accommodate the varying needs of child travel safety.

Another aspect of the present invention is to provide a bracelet alert device that does not require electricity or batteries to remain active.

A further aspect of the present invention is to provide an alert device that can be easily, detachably installed for use with a child safety seat.

Another aspect of the present invention is to provide an alert device that reminds the wearer to carry their child along with them; else, if forgotten, indicates to others that a user may have left a child in their vehicle.

It is still another aspect of the present invention to provide a new and improved bracelet alert device which may be easily and efficiently manufactured and marketed.

It is a further aspect of the present invention to provide a new and improved bracelet alert device which is of a durable and reliable construction.

An even further aspect of the present invention is to provide a new and improved bracelet alert device which is susceptible to a low cost of manufacture with regard to both materials and labor, and which accordingly is then susceptible of low prices of sale to the consuming public, thereby making such devices economically available to the buying public.

Another aspect of the present invention is it's designed to actually remind the user to engage its protection system; subsequently a child cannot be fastened in a child safety seat without first coming in direct contact with the invention.

Lastly, it is an aspect of the present invention to provide the bracelet alert device which is simple and convenient to use and has an ability to save lives of babies, toddlers and any age child with or without special needs who have not learned to unbuckle their car seat and exit the vehicle on their own.

Other aspects of the present invention will become apparent from time to time throughout the specification as hereinafter related.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty which characterize the invention, are pointed out with particularity in the disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
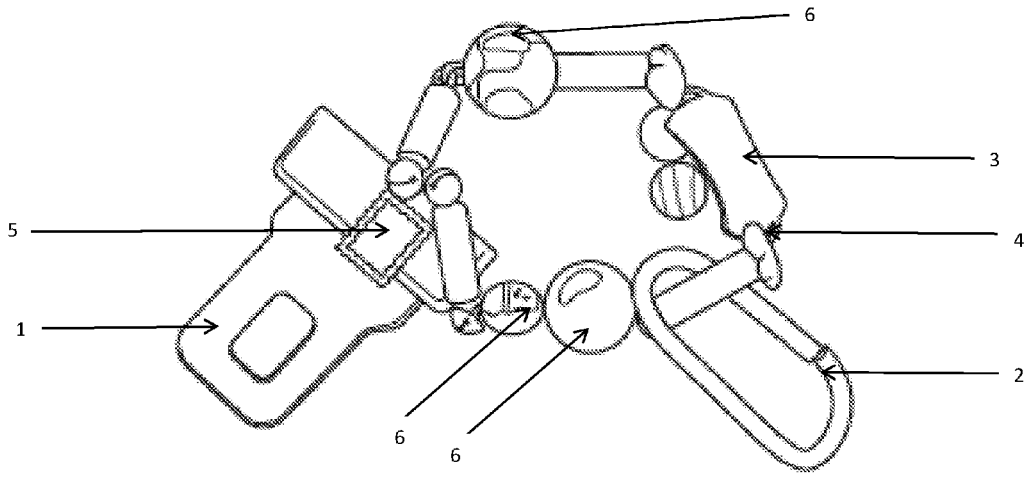
FIG. 1 is a perspective view of the bracelet alert device.

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that the embodiments may be combined, or that other embodiments may be utilized and that structural and logical changes may be made without departing from the spirit and scope of the present invention. The following detailed description is, therefore, not to be taken in a limiting sense, and the scope of the present invention is defined by the appended claims and their equivalents.

In some preferred embodiments, the present invention provides a bracelet alert device, a child safety/awareness imperative that is worn as a bracelet and acts as a reminder device. The alert device functions to prevent the tragedy of baby being left in a hot car as the device is designed intrinsically to never be forgotten and to never let baby forgotten in the vehicle. The bracelet alert device reminds the wearer to carry their child along with them; else, if forgotten, indicates to others that a user may have left a child in their vehicle; and thereby saves many lives.

In one embodiment, the inventive bracelet device comprises the three, signature, giant beads with the "Bring Baby Bracelet" (BBB) logo, a color matching functional carabiner for attachment with the male end of the child safety seat belt buckle, a color matching functional male end seatbelt adapter piece to fastened with the female end of the child safety seat belt buckle and a matching "official child safety apparatus" tag, thereby a universal indicators that signify a baby has been left in a car. The tag comprises a card stock bookmark or a magnet that on one side displays a symbol and meaning of the various charms and the other side displays the instructions for properly using the inventive device. In one embodiment, the bracelet is equipped with multiple adapter pieces to accommodate varying needs of child travel safety. Every unit has one male car seat buckle (with tongue) to click into female end of child safety seat belt buckle and/or one carabiner to hook on female end of child safety seat belt buckle.

In a further preferred embodiment, the inventive bracelet is only a visual alert device to remind the presence of babies and thus does not require any electricity or batteries to remain active, therefore no battery replacement, no charger, no updates or upgrades, etc.

The inventive bracelet is provided to be utilized as easy and automatic as fastening the seatbelt. The bracelet is clipped into child safety seat belt buckle upon first time opening a new device, and before baby ever sit's in the car seat. The device will thereon live in the child safety seat belt buckle and it is impossible to fasten baby without taking the bracelet out and conveniently placing it on the most practical place on the user's wrist. The bracelet device thus stays on the wrist throughout travel and does not come off until the wearer release baby from car seat buckle. While exiting from the vehicle (car, herein), the bracelet thus reminds the wearer to take out the baby. When the user unbuckles the baby, he/she can take the bracelet off from the wrist and reattach the bracelet back into the child safety seat buckle, setting a visual alert for the next drive.

Further, in one embodiment the bracelet is not provided with a beautiful profile but comfortable, and distracting enough for user to avoid wearing outside of automobile, in front of the friends, acquaintances and business associates or out shopping, thus engaging it's child safety reminder element. In one embodiment, the bracelet is gaudy, interesting, and with a universal profile so that everyone knows what it is or if anyone sees someone wearing the bracelet, they are compelled to walk directly up to the person that is wearing it and conveying them to go out to their car and get their baby.

Referring to FIG. 1, the bracelet alert device includes the three signature oversized beads 6, the male end seatbelt clip 1, the carabiner 2, the cardstock bookmark 3, and the frame 5 for baby picture, all together sewn in the elastic encircling band 4.

Figure 2:
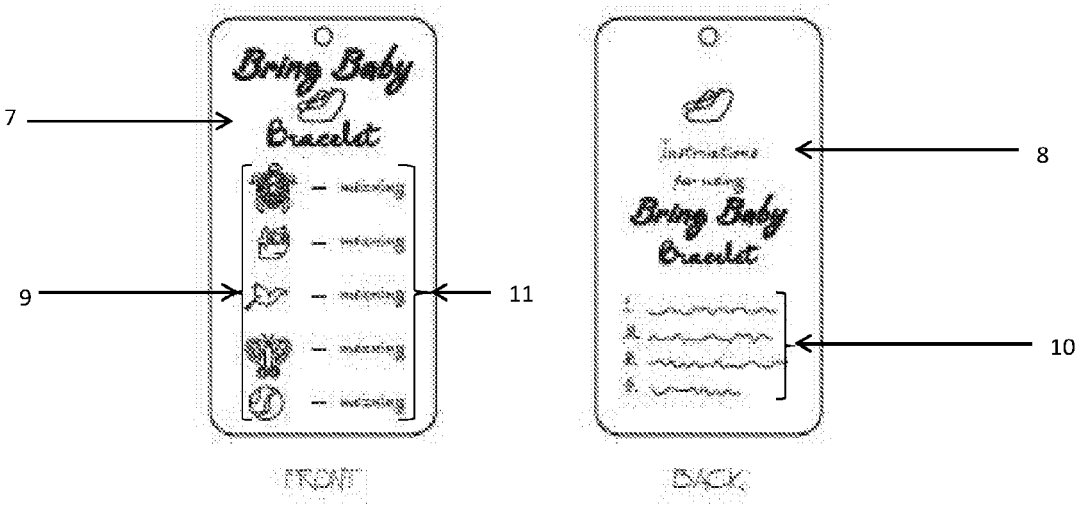
FIG. 2 is a front and back view of the cardstock bookmark of the bracelet alert device.

FIG. 2 illustrates the front 7 and back 8 view of the cardstock bookmark 3 of the bracelet alert device displaying symbols 9 and their meanings 11 of the various charms, and the instructions 10 for properly using the bracelet alert device respectively. As shown in front side 7, various symbols 9 have each and specific meaning. The elephant symbolizes strength denoting the determination to protect baby. The owl symbolizes wisdom denoting the user to be wise to utilize the most practical and powerful methods to protect the baby. The turtle stands for longevity because for aiming care for the precious children to give them the longest, healthiest life possible. The heart shape frame symbolizes the love for the baby/child who is on the hearts evermore. The bells symbolize life, its power to exist, and the resounding celebration of living it well. The bells are also functional as they resound to protect baby. Further, on the back side 8 of the cardstock bookmark 3, instructions 10 to use, are provided.

Figure 3:
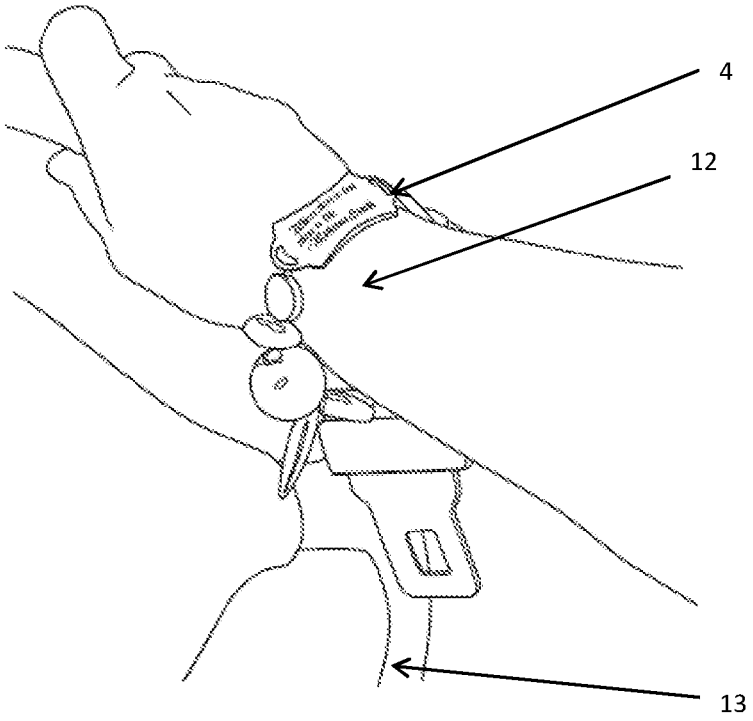
FIG. 3 is a perspective view of the bracelet alert device worn in the hand of the wearer while driving along with the child.

Further embodiment discloses another perspective view of the bracelet alert device worn in the hand of the wearer while driving along with the child as is represented in FIG. 3, which comprises the above disclosed components of the bracelet alert device (as shown and illustrated by FIG. 1).

As illustrated in FIG. 3, in the preferred embodiment, the bracelet alert device is adapted to slide onto a wrist 12 of the user. The bracelet alert device includes an encircling band 4 adapted to encircle the user's wrist 12 while holding the vehicle's steering 13. In the preferred embodiment, the encircling band 4 includes an elastic sizing element that enables the user to adjust the circumference of the bracelet alert device to ensure a secure fit around the user's wrist 12.

As may now be appreciated from the above description and reference to the accompanying drawings, the present invention provides a bracelet alert device which may be utilized by the parents to visually alert them about the presence of their child along with them.

While we describe this invention in terms of remembering children, it is also intended to include pets and similar things to be remembered. The term child is hereby defined to include pet or other similar animal or thing to be remembered.

It is to be understood that the above description is intended to be illustrative, and not restrictive. For example, the above-discussed embodiments may be used in combination with each other. Many other embodiments will be apparent to those of skill in the art upon reviewing the above description.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A bracelet alert device comprising:

three beads each having a logo thereon;

a color matching functional carabiner for attachment with a male end of a child safety seat belt buckle;

a color matching functional male end seatbelt adapter piece to be fastened with a female end of the child safety seat belt buckle, and a matching official child safety apparatus tag including a card stock bookmark or a magnet, displaying a symbol and meaning of various charms on one side and instructions for properly using the said bracelet alert device the other side.

2. A bracelet alert device comprising:

an encircling band;

a carabiner affixed to said encircling band, said carabiner for attachment with the male end of the child safety sat belt buckle; and a male end seat belt adapter piece affixed to said encircling band, said male end seat belt adapter piece to be fastened with a female end of the child safety seat belt buckle.

* * * * *